US011741907B2

(12) United States Patent
Yoon et al.

(10) Patent No.: US 11,741,907 B2
(45) Date of Patent: Aug. 29, 2023

(54) DISPLAY DEVICE INCLUDING MULTIPLEXERS WITH DIFFERENT TURN-ON PERIODS

(71) Applicant: LG Display Co., Ltd., Seoul (KR)

(72) Inventors: Byunggi Yoon, Paju-si (KR); Sangkyu Kim, Paju-si (KR); Sangsoo Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/561,376

(22) Filed: Dec. 23, 2021

(65) Prior Publication Data

US 2022/0208117 A1 Jun. 30, 2022

(30) Foreign Application Priority Data

Dec. 31, 2020 (KR) ..... 10-2020-0189367

(51) Int. Cl.
*G09G 3/3275* (2016.01)

(52) U.S. Cl.
CPC ... *G09G 3/3275* (2013.01); *G09G 2310/0297* (2013.01)

(58) Field of Classification Search
CPC ..... G09G 3/3275
USPC ..... 345/204
See application file for complete search history.

(56) References Cited

U.S. PATENT DOCUMENTS

2013/0141320 A1 6/2013 Kim
2014/0146030 A1* 5/2014 Lee ..... G09G 3/3208 345/212
2016/0078845 A1 3/2016 Lin et al.
2021/0166628 A1* 6/2021 Huang ..... G09G 3/3258

FOREIGN PATENT DOCUMENTS

JP 2008-233454 A 10/2008
KR 10-2020-0081856 A 7/2020
WO WO 2018/223652 A1 12/2018
WO WO 2018/235130 A1 12/2018

* cited by examiner

*Primary Examiner* — Long D Pham
(74) *Attorney, Agent, or Firm* — Birch, Stewart, Kolasch & Birch, LLP

(57) ABSTRACT

A display device can include a display panel including multiple pixels each of which includes multiple sub-pixels. The display device can further include multiple data lines respectively connected to the multiple sub-pixels, multiple gate lines respectively connected to the multiple pixels, and N multiplexers (MUX) (N is a natural number larger than 1) disposed at input terminals of the multiple data lines. In one horizontal (H) period, a length of a turn-on period of a first MUX can be different from that of a turn-on period of an Nth MUX, where the one H period is a period in which a scan signal is supplied through one gate line.

17 Claims, 12 Drawing Sheets

【Fig 1】
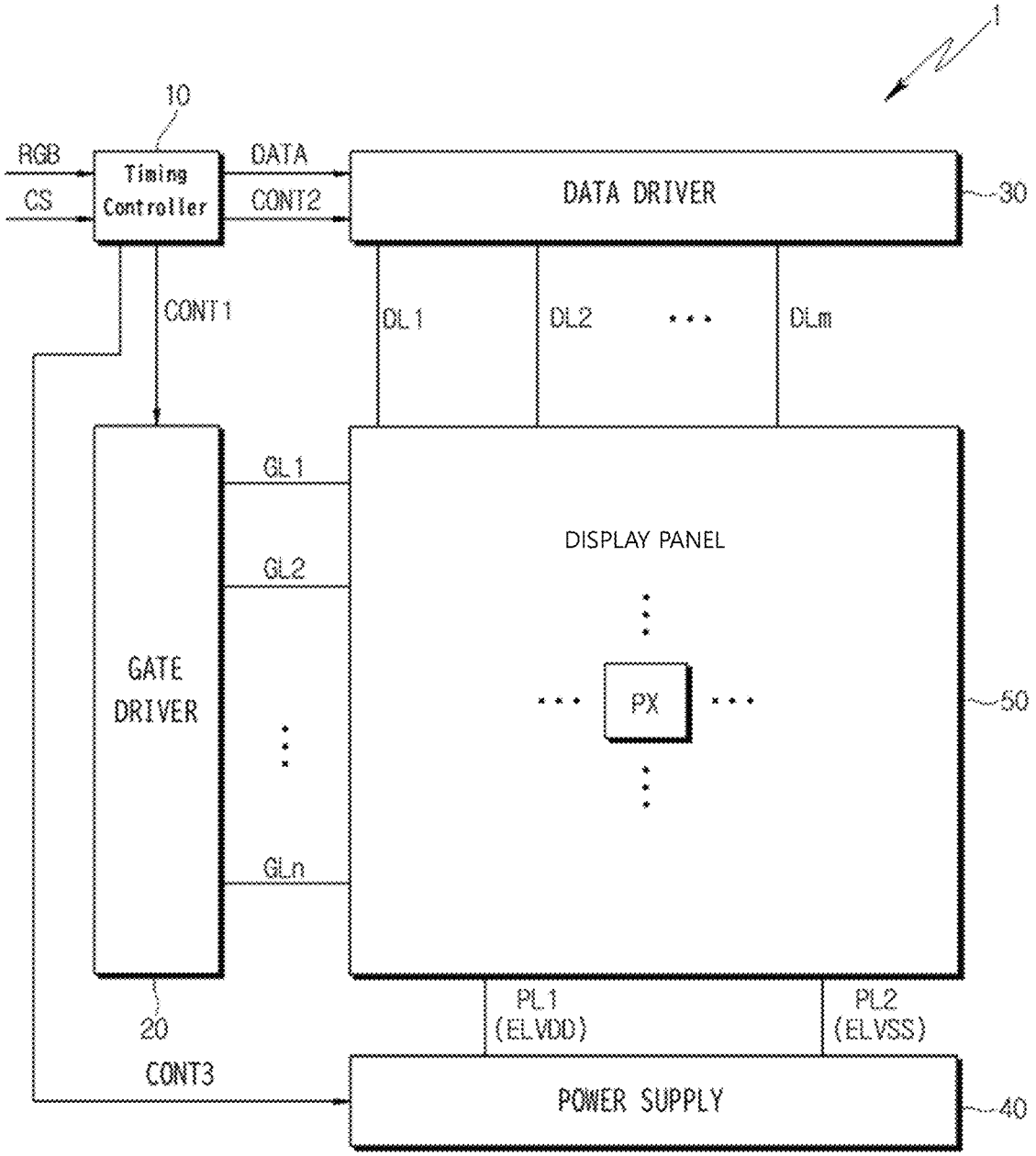

【Fig 2】
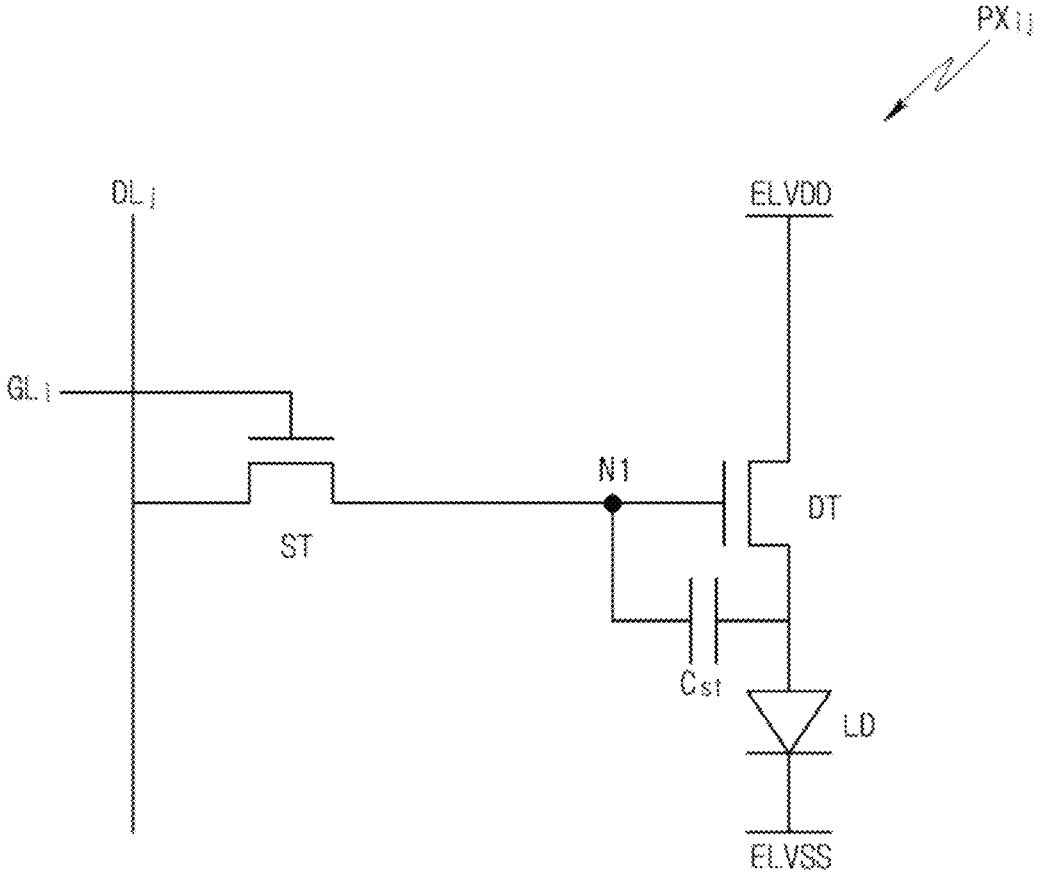

【Fig 3】
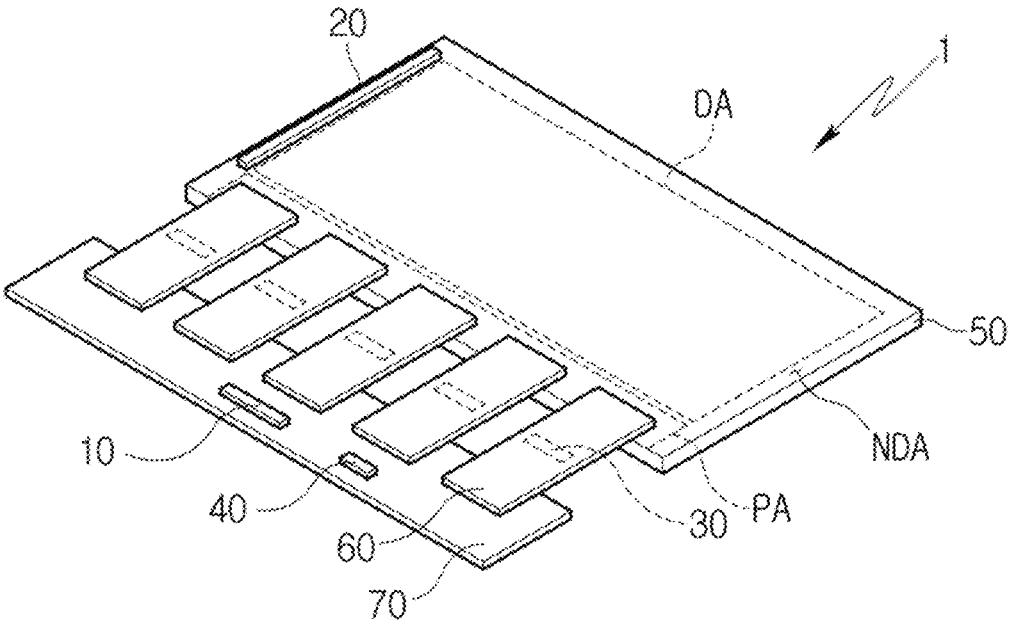
【Fig 4】
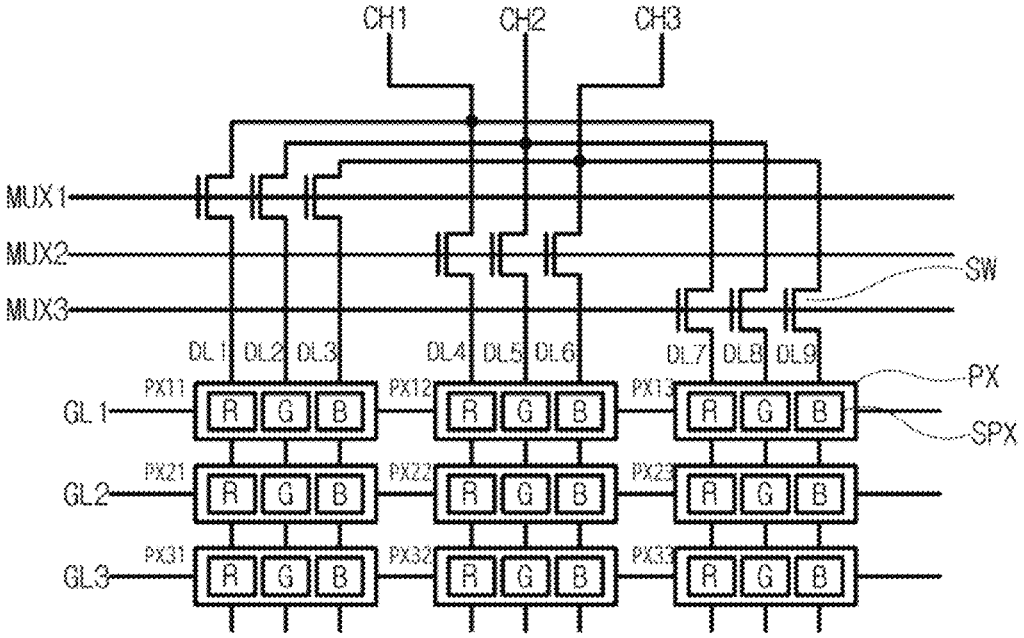

【Fig 5】
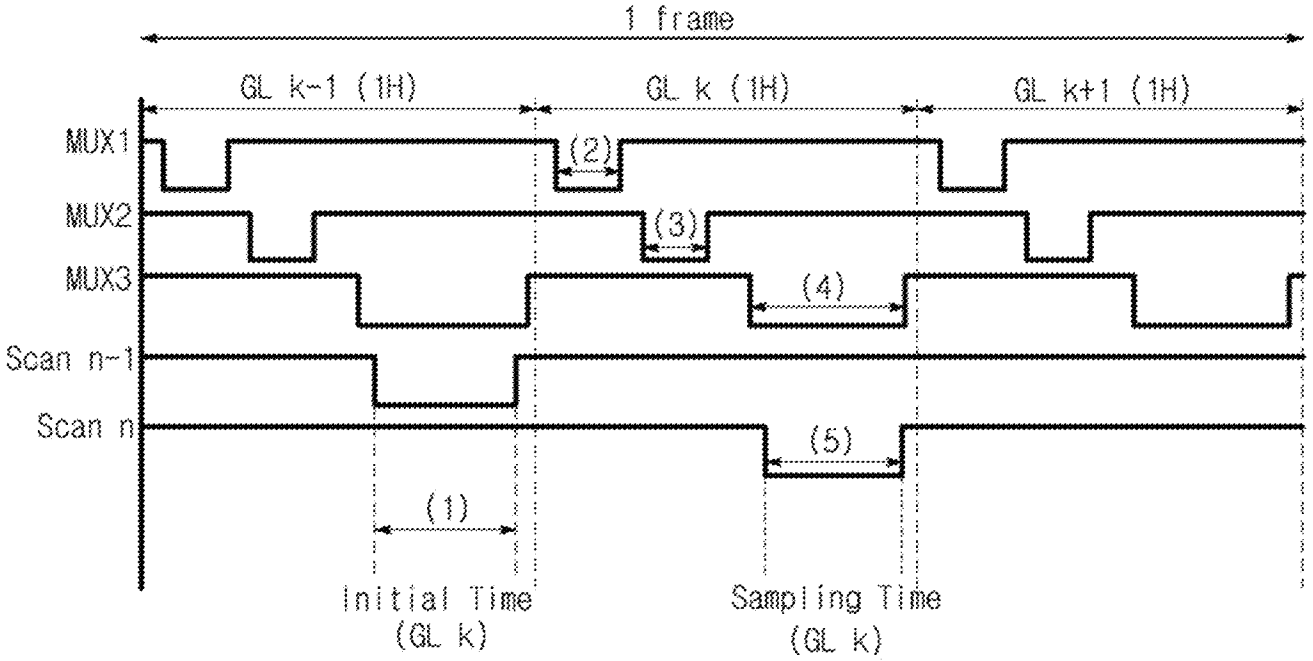

【Fig 6】
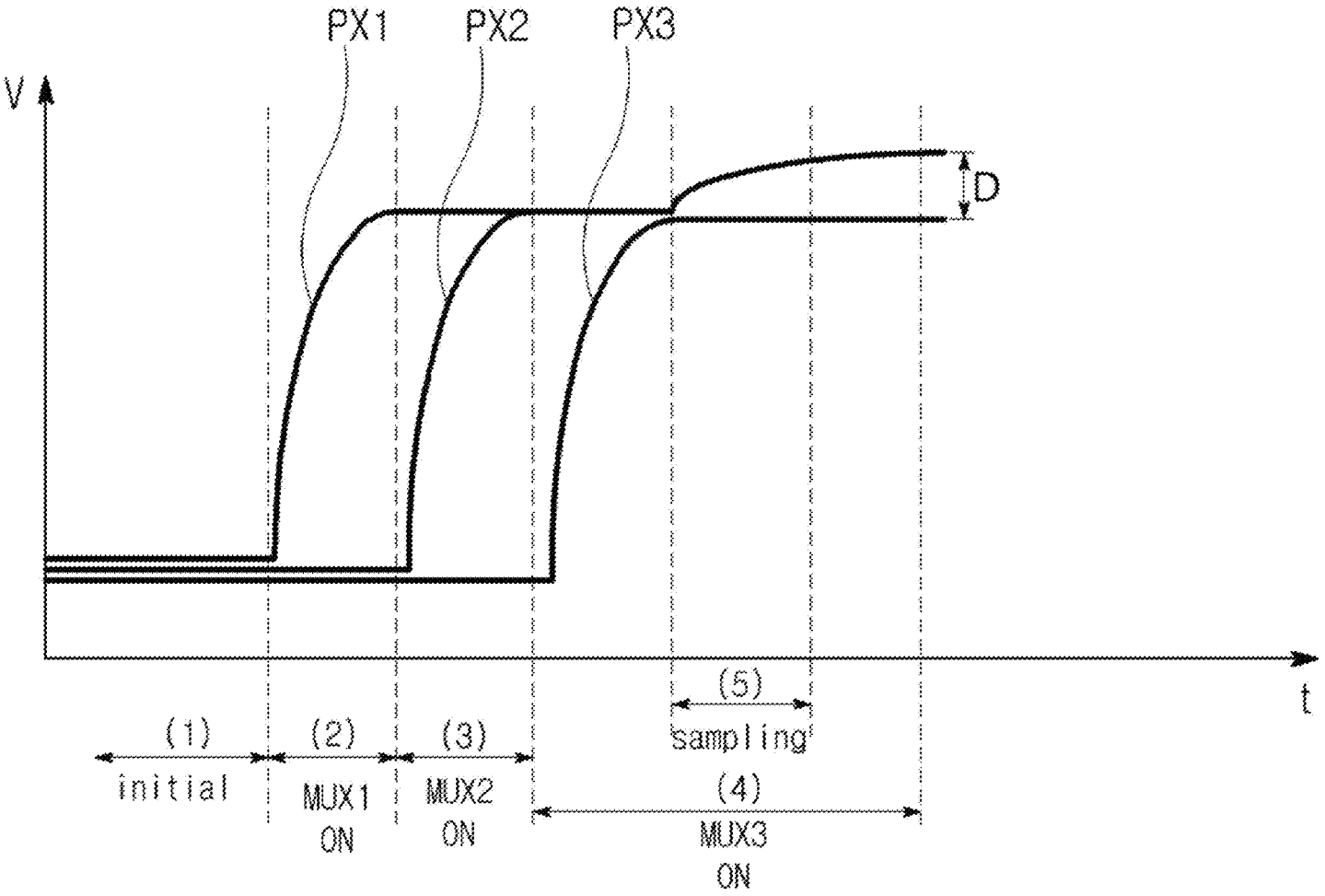

【Fig 7】
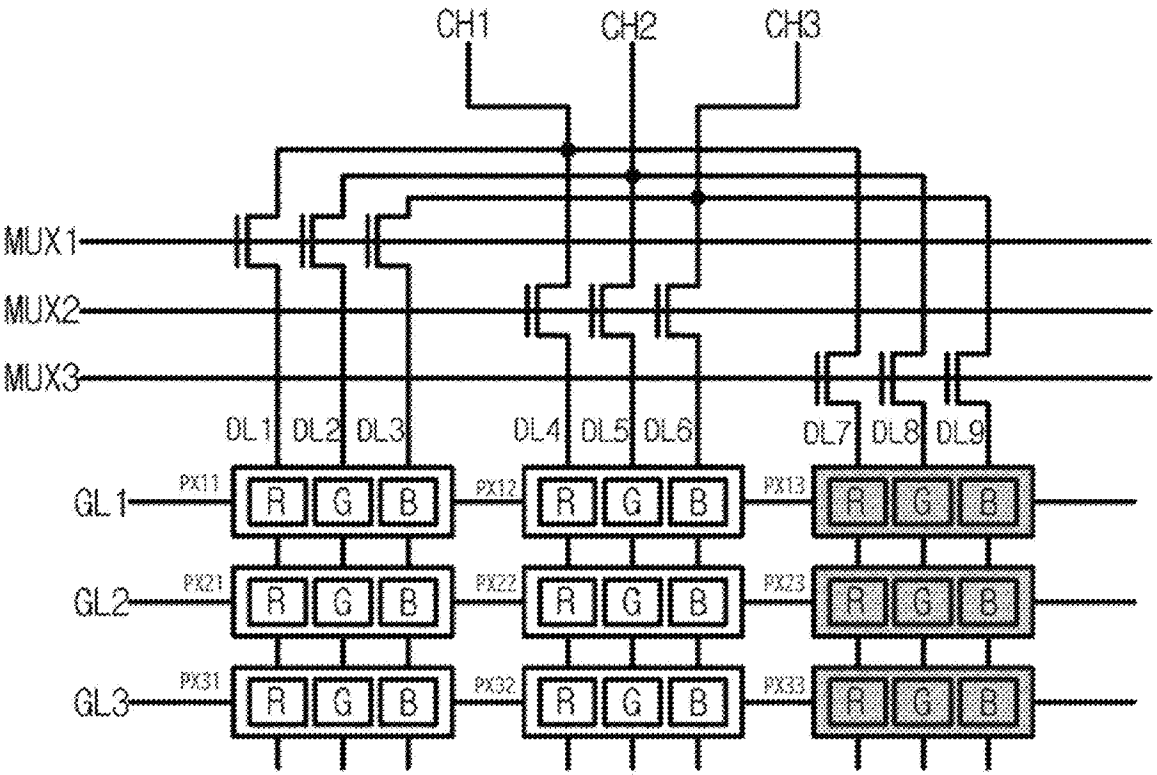

【Fig 8】
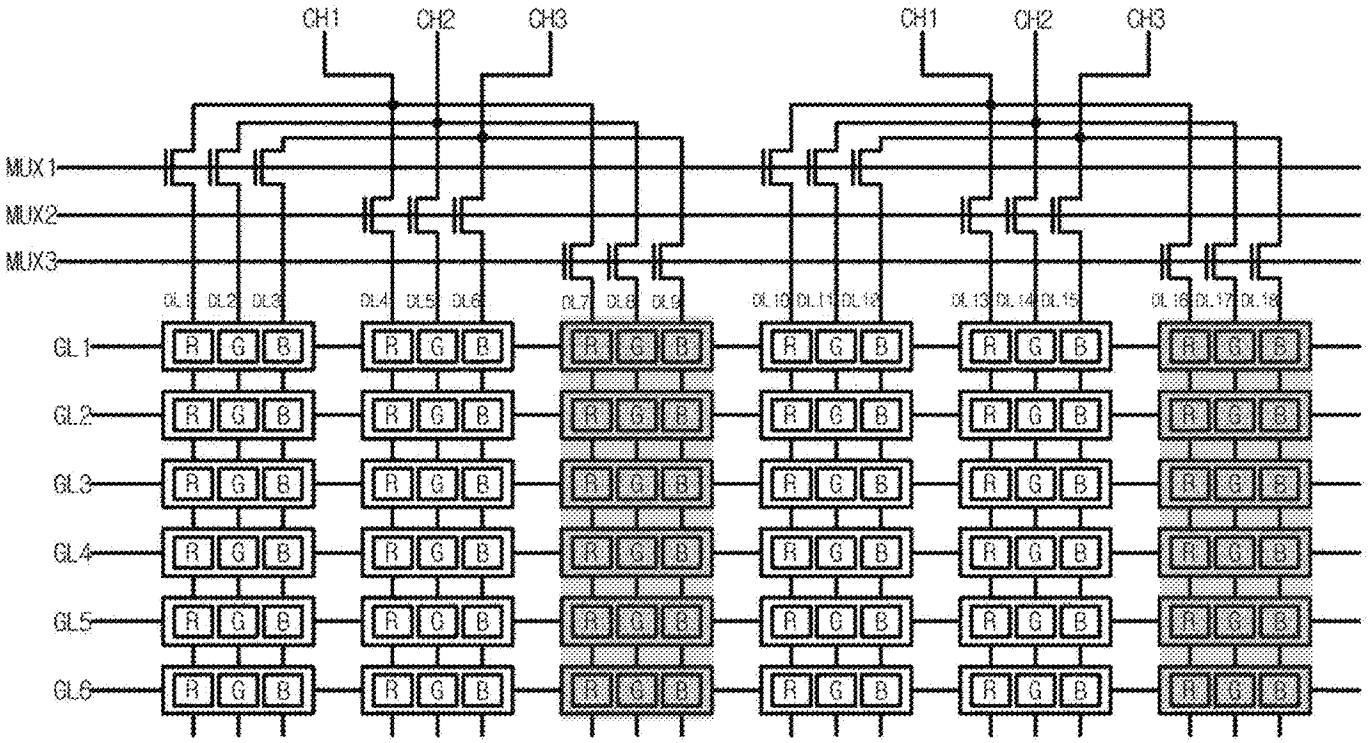

【Fig 9】
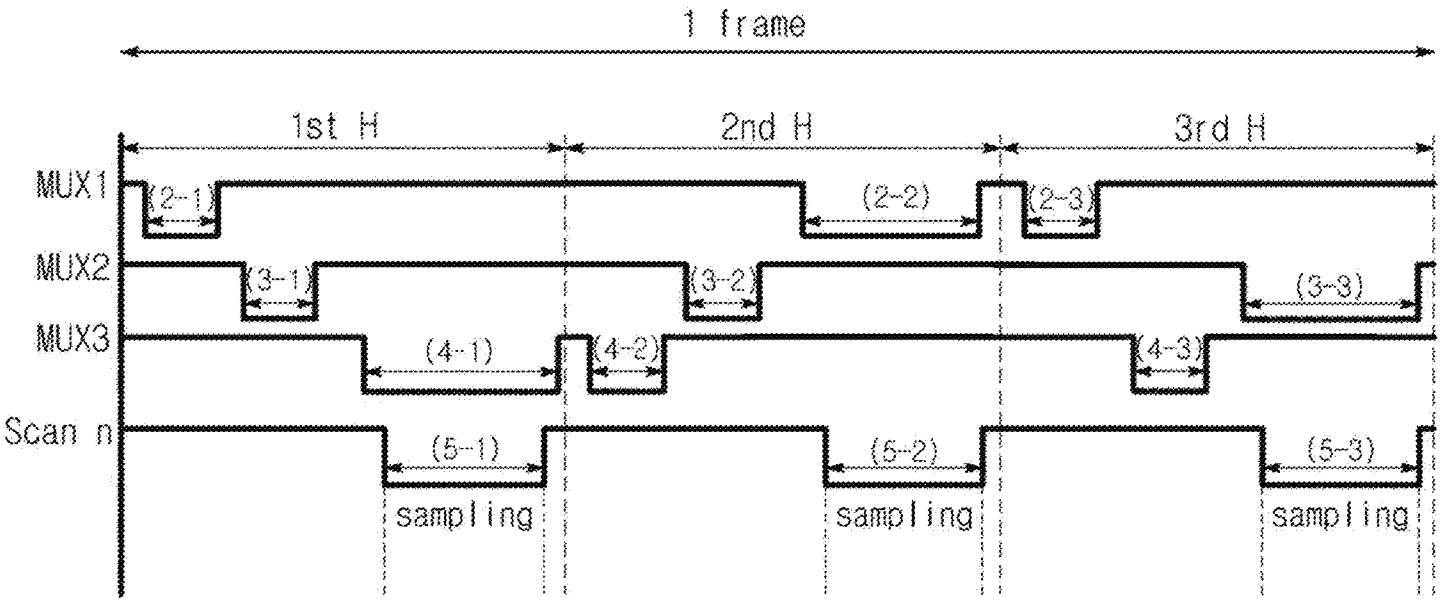

【Fig. 10】
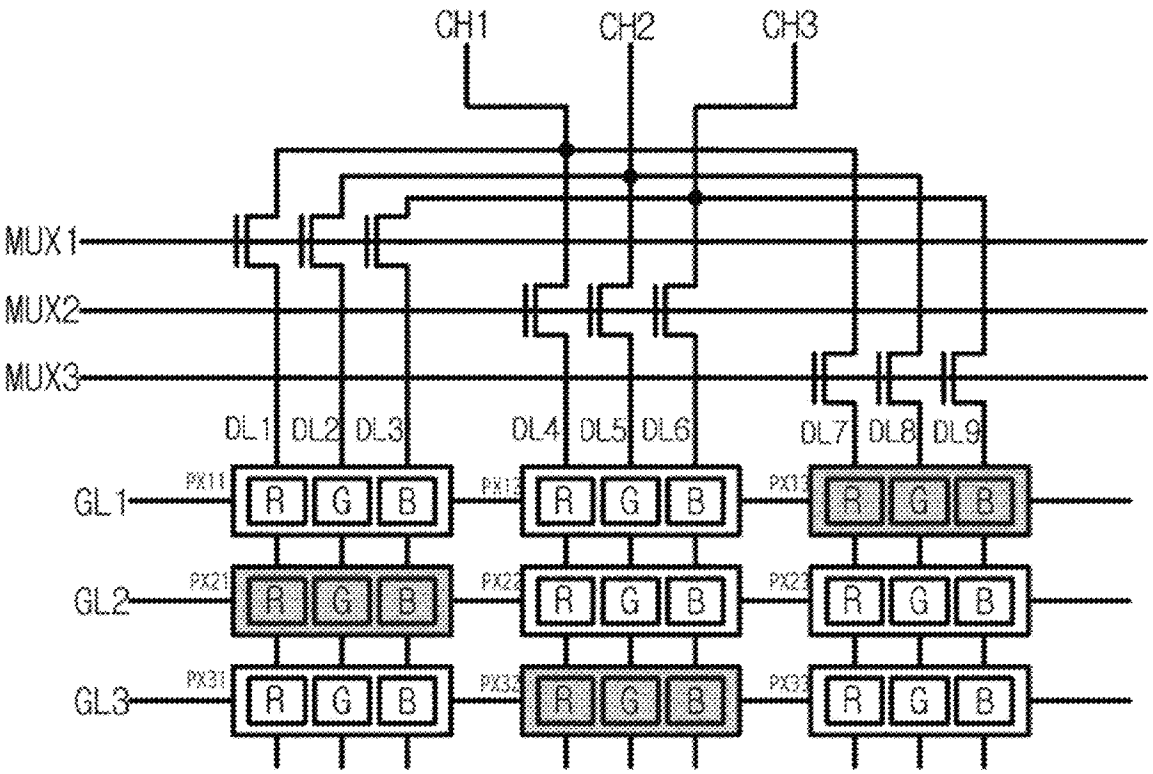

[Fig. 11]
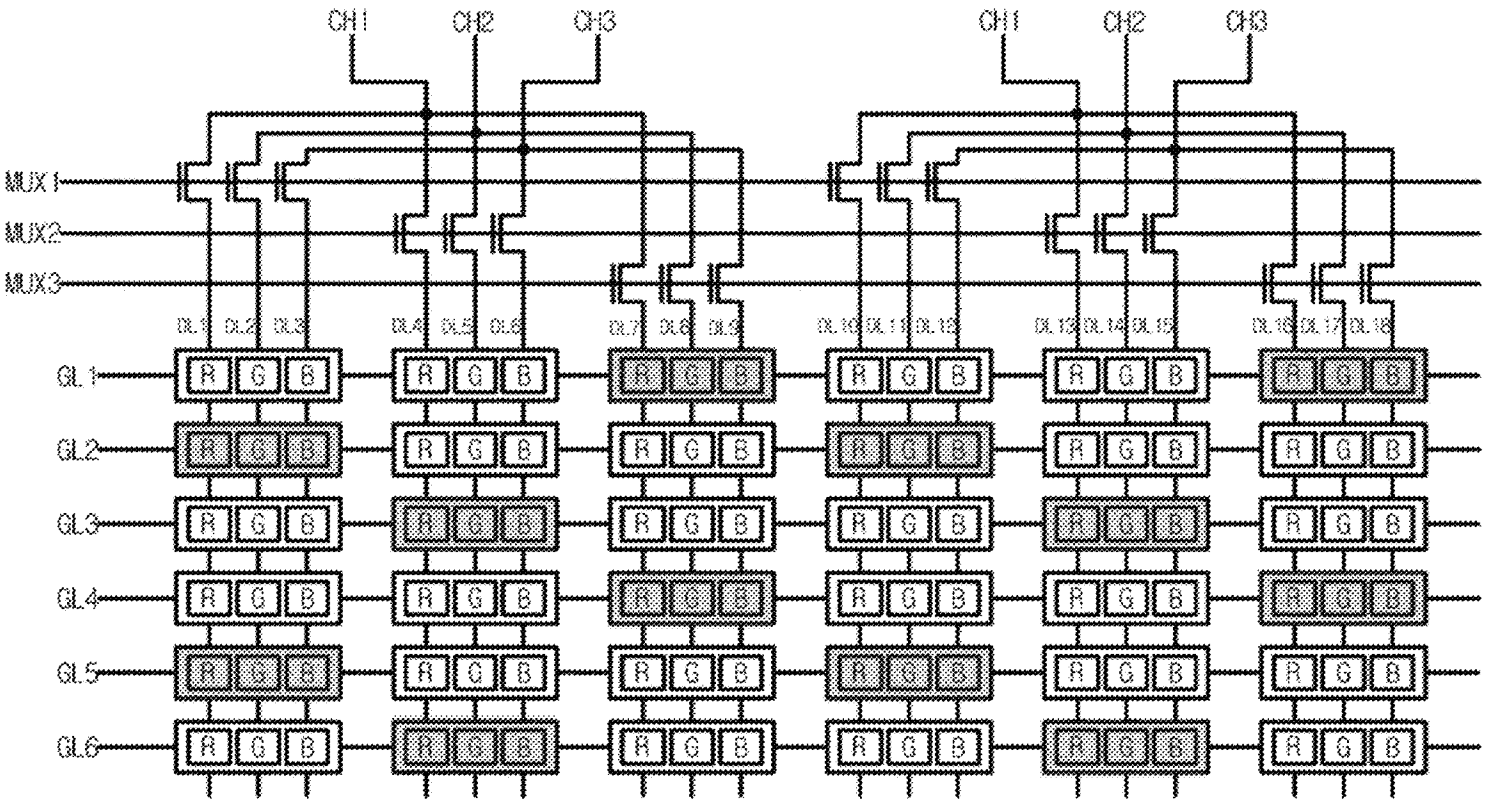

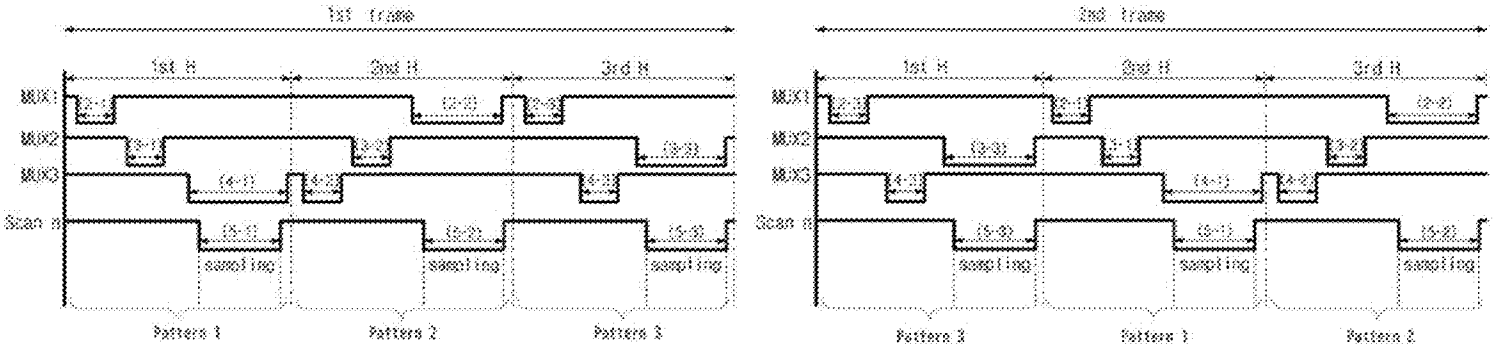
FIG. 12A
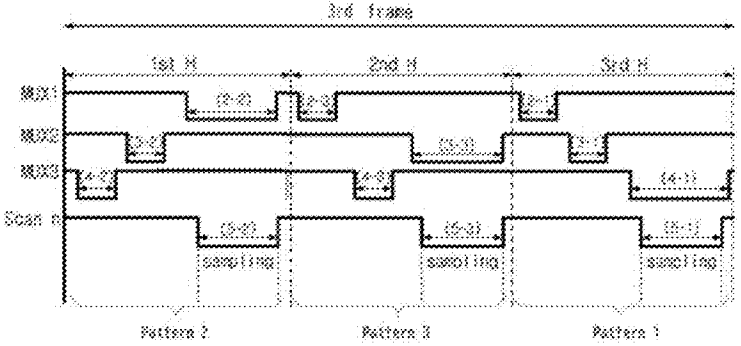
FIG. 12B
FIG. 12C

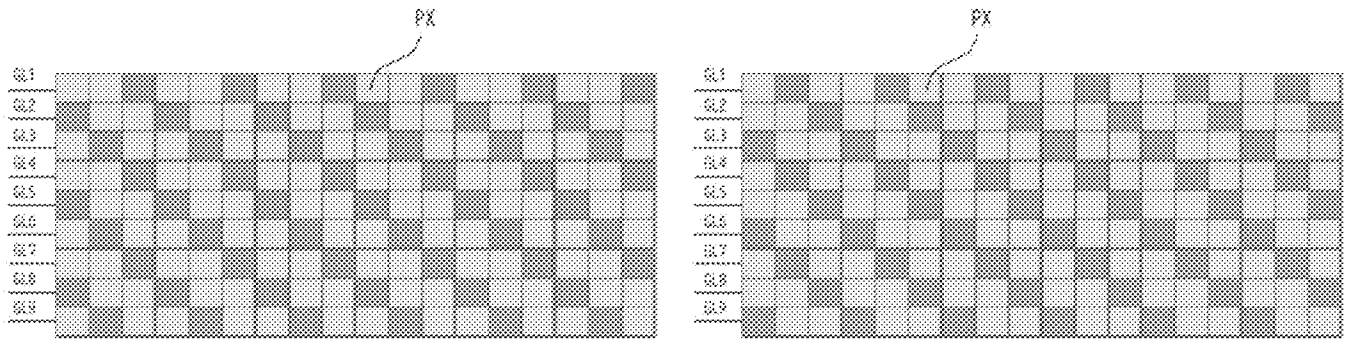
FIG. 13A
FIG. 13B
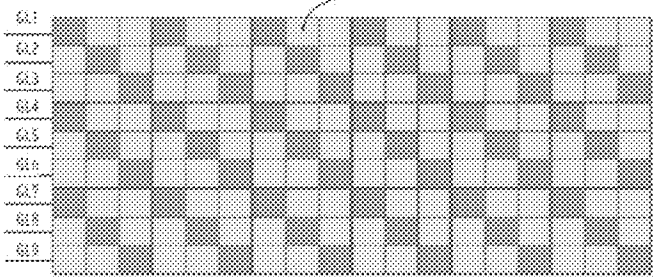
FIG. 13C

DISPLAY DEVICE INCLUDING MULTIPLEXERS WITH DIFFERENT TURN-ON PERIODS

CROSS-REFERENCE TO RELATED APPLICATIONS

This application claims priority to Korean Patent Application No. 10-2020-0189367, filed on Dec. 31, 2020 in the Republic of Korea, the entire contents of which are hereby expressly incorporated by reference in its entirety into the present application.

BACKGROUND OF THE INVENTION

Field of the Invention

The present disclosure relates to a display device. More particularly, the present disclosure relates to a display device including multiplexers (MUX) connected to data lines.

Description of the Related Art

With the advancement of information-oriented society, various types of display devices have been developed. Recently, various display devices such as a liquid crystal display (LCD) device, a plasma display panel (PDP) display device, and an organic light-emitting display (OLED) device have been utilized.

Generally, an organic light-emitting element included in the organic light-emitting display device is self-luminous and does not require a separate light source, so that a thickness and a weight of the display device can be reduced. In addition, the organic light-emitting display device has high quality characteristics, such as low power consumption, high luminance, and a high response rate.

In such an organic light-emitting display device, much research has been conducted on reducing a bezel size, realizing a large screen, driving at a high speed, increasing the stability of a light-emitting element, and so on.

However, there may be a limitation that image quality can be degraded due to the driving characteristic of the organic light-emitting element, thus there can be a need for preventing or reducing degradation of image quality.

SUMMARY OF THE INVENTION

The embodiments of the present disclosure are directed to providing an improved display device, which can address the limitations and disadvantages associated with the related art.

In embodiments, there is provided a display device capable of improving quality of an image that can be provided by driving the display device using a multiplexer (MUX).

A display device according to an embodiment of the present disclosure can include a display panel including multiple pixels each having multiple sub-pixels, multiple data lines respectively connected to the multiple sub-pixels, multiple gate lines respectively connected to the multiple pixels, and N multiplexers (MUX) (N is a natural number larger than 1) disposed at input terminals of the multiple data lines, wherein, in one horizontal (H) period, a length of a turn-on period of a first MUX can be different from that of a turn-on period of an Nth MUX, where the one H period is a period in which a scan signal is supplied through one gate line.

In the display device, in the one H period, a MUX having the longest turn-on period can be performed last comparing to the other MUXs, and the turn-on period of the MUX that is performed last can overlap a sampling period of a scan signal.

In the display device, a turn-on start time of the MUX that is performed last can precede a start time of the sampling period of the scan signal.

In the display device, a length of a turn-on period of the first MUX in a first H period can be different from that of a turn-on period of the first MUX in a second H period.

In the display device, a length of a turn-on period of the Nth MUX in a first H period can be different from that of a turn-on period of the Nth MUX in a second H period.

In the display device, a length of a turn-on period of the first MUX in a first H period can be the same as that of a turn-on period of the Nth MUX in a second H period, and a length of a turn-on period of the Nth MUX in the first H period can be the same as that of a turn-on period of the first MUX in the second H period.

In the display device, a length of a turn-on period of the first MUX can change depending on the gate line.

In the display device, a length of a turn-on period of the first MUX can vary depending on the H period, and the length of the turn-on period of the first MUX can vary depending on a frame.

In the display device, a length of a turn-on period of the Nth MUX can vary depending on the H period, and the length of the turn-on period of the Nth MUX can vary depending on a frame.

In the display device, the N MUXs can include the first MUX, a second MUX, and a third MUX, a turn-on period of each of the first MUX, the second MUX, and the third MUX in a first H period in a first frame can have a first pattern, in which the turn-on period of the third MUX can be the longest, the turn-on period of the third MUX can overlap a sampling period, and a start time of the turn-on period of the third MUX can precede a start time of the sampling period.

In the display device, in a second H period that is performed after the first H period in the first frame, the turn-on period of each of the first MUX, the second MUX, and the third MUX can have a second pattern that is different from the first pattern.

In the display device, in a third H period that is performed after the second H period in the first frame, the turn-on period of each of the first MUX, the second MUX, and the third MUX can have a third pattern that is different from the first and second patterns.

In the display device, a second frame can be performed after the first frame, a fourth pattern of the turn-on period of each of the first MUX, the second MUX, and the third MUX in a first H period in the second frame can be different from the first pattern, a fifth pattern of the turn-on period of each of the first MUX, the second MUX, and the third MUX in a second H period in the second frame can be different from the second pattern, and a sixth pattern of the turn-on period of each of the first MUX, the second MUX, and the third MUX in a third H period in the second frame can be different from the third pattern.

In the display device, a third frame can be performed after the second frame, a seventh pattern of the turn-on period of each of the first MUX, the second MUX, and the third MUX in a first H period in the third frame can be different from the fourth pattern, an eighth pattern of the turn-on period of each of the first MUX, the second MUX, and the third MUX in a second H period in the third frame can be different from the fifth pattern, and a ninth pattern of the turn-on period of each of the first MUX, the second MUX, and the third MUX in a third H period in the third frame can be different from the sixth pattern.

In embodiments of the display device according to the present disclosure, there is provided a display device capable of improving quality of an image generated by driving the MUXs.

BRIEF DESCRIPTION OF THE DRAWINGS

The above and other objectives, features, and other advantages of the present disclosure will be more clearly understood from the following detailed description when taken in conjunction with the accompanying drawings, in which:

FIG. 1 is a block diagram illustrating a configuration of a display device according to an embodiment of the present disclosure;

FIG. 2 is a circuit diagram illustrating an example of a pixel illustrated in FIG. 1;

FIG. 3 is a perspective view schematically illustrating a display panel illustrated in FIG. 1;

FIG. 4 is a view illustrating driving of multiplexers (MUXs) according to an embodiment of the present disclosure;

FIG. 5 is a view illustrating the driving of the MUXs and driving of a scan signal according to an embodiment of the present disclosure;

FIG. 6 shows a graph illustrating signal charging of the pixels by the driving of the MUXs according to an embodiment of the present disclosure;

FIGS. 7 and 8 are views illustrating a light-emitting of the pixels by the driving of the MUXs according to an embodiment of the present disclosure;

FIG. 9 is a view illustrating the driving of the MUXs and the driving of the scan signal according to an embodiment of the present disclosure;

FIGS. 10 and 11 are views illustrating the light-emitting of the pixels by the driving of the MUXs according to an embodiment of the present disclosure;

FIGS. 12A to 12C are views illustrating the driving of the MUXs and the driving of the scan signal according to an embodiment of the present disclosure; and FIGS. 13A to 13C are views illustrating the light-emitting of the pixels by the driving of the MUXs according to an embodiment of the present disclosure.

DETAILED DESCRIPTION OF THE EMBODIMENTS

Hereinafter, embodiments of the present disclosure will be described in detail with reference to the accompanying drawings. In this specification, it will be understood that when one component (or region, layer, portion) is referred to as being "disposed on", "connected to", or "coupled to" another component, it can be directly disposed/connected/coupled on/to the one component, or an intervening third component can also be present.

Like reference numerals refer to like elements throughout. Also, in the drawings, the thickness, ratio, and dimensions of components are exaggerated for clarity of illustration. The term "and/or" includes one or more combinations that the associated elements can define.

It will be understood that although the terms such as "first" and "second" are used herein to describe various elements, these elements should not be limited by these terms. The terms are only used to distinguish one component from other components and may not define order. For example, an element referred to as a first element in one embodiment can be referred to as a second element in another embodiment without departing from the scope of the appended claims. The terms of a singular form can include plural forms unless referred to the contrary.

Also, "under", "below", "above", "upper", and the like are used for explaining a relation association of components illustrated in the drawings. These terms are relative concepts and are described on the basis of the direction in the drawings.

The meaning of the term "include" or "comprise" specifies a property, a fixed number, a step, an operation, an element, a component or a combination thereof, but does not exclude other properties, fixed numbers, steps, operations, elements, components or combinations thereof.

FIG. 1 is a block diagram illustrating a configuration of a display device according to an embodiment of the present disclosure. All the components of each display device according to all embodiments of the present disclosure are operatively coupled and configured.

Referring to FIG. 1, a display device 1 includes a timing controller 10, a gate driver 20, a data driver 30, a power supply 40, and a display panel 50.

The timing controller 10 can receive an image signal RGB and a control signal CS from outside. The image signal RGB can include a plurality of gray scale data. The control signal CS can include, for example, a horizontal synchronization signal, a vertical synchronization signal, and a main clock signal.

The timing controller 10 can process the image signal RGB and the control signal CS to make the signals appropriate for an operation condition of the display panel 50. The timing controller 10 can generate and output image data DATA, a gate driving control signal CONT1, a data driving control signal CONT2, and a power supply control signal CONT3.

The gate driver 20 can be connected to pixels PXs of the display panel 50 through multiple gate lines GL1 to GLn where n is a natural number such as a positive integer. The gate driver 20 can generate gate signals on the basis of the gate driving control signal CONT1 output from the timing controller 10. The gate driver 20 can provide the generated gate signals to the pixels PXs through the multiple gate lines GL1 to GLn.

The data driver 30 can be connected to the pixels PXs of the display panel 50 through multiple data lines DL1 to DLm where m is a natural number such as a positive integer. The data driver 30 can generate data signals on the basis of the image data DATA and the data driving control signal CONT2 output from the timing controller 10. The data driver 30 can provide the generated data signals to the pixels PXs through the multiple data lines DL1 to DLm.

In various embodiments, the data driver 30 can be further connected to the pixels PXs of the display panel 50 through multiple sensing lines (or reference lines) SL1 to SLm. The data driver 30 can provide a reference voltage (a sensing voltage, or an initialization voltage) to the pixels PXs through the multiple sensing lines SL1 to SLm. The data driver 30 can sense states of the pixels PXs on the basis of an electrical signal fed back from the pixels PXs.

The power supply 40 can be connected to the pixels PXs of the display panel 50 through multiple power lines PL1 and PL2. The power supply 40 can generate a driving voltage to be provided to the display panel 50, on the basis of the power supply control signal CONT3. The driving voltage can include, for example, a high-potential driving voltage ELVDD and a low-potential driving voltage ELVSS. The power supply 40 can provide the generated driving voltages ELVDD and ELVSS to the pixels PXs, through corresponding power lines PL1 and PL2.

In the display panel 50, the multiple pixels PXs are disposed, each of which can include multiple sub-pixels. The pixels PXs can be, for example, arranged in a matrix form on the display panel 50.

Each pixel PX can be electrically connected to the corresponding gate line and the corresponding data line (and corresponding sensing lines or reference lines). The pixels PXs can emit light with luminance corresponding to the gate signals and the data signals that are supplied through the gate lines GL1 to GLn and the data lines DL1 to DLm, respectively.

Each pixel PX can display any one of a first to a third colors. Each pixel PX can display any one of red, green, and blue colors. In another embodiment, each pixel PX can display any one of cyan, magenta, and yellow colors. In various embodiments, the pixels PXs can be configured to display any one of four or more colors. For example, each pixel PX can also display any one of red, green, blue, and white colors.

As described below, in an embodiment, each pixel PX can include three sub-pixels that display the first to the third colors respectively. In various embodiments, the pixel can include four or more sub-pixels that display the four or more colors respectively.

The timing controller 10, the gate driver 20, the data driver 30, and the power supply 40 can be configured as separate integrated circuits (ICs), or ICs in which at least some thereof are integrated. For example, at least one among the data driver 30 and the power supply 40 can be configured as an integrated circuit integrated with the timing controller 10.

In addition, in FIG. 1, the gate driver 20 and the data driver 30 are illustrated as elements separated from the display panel 50. However, at least one among the gate driver 20 and the data driver 30 can be configured in an in-panel manner that is formed integrally with the display panel 50. For example, the gate driver 20 can be formed integrally with the display panel 50 according to a gate-in-panel (GIP) manner.

Here, the display device 1 can include a multiplexer (MUX) disposed at input terminals of the multiple data lines DL1 to DLm. The MUX can be implemented by using a switching transistor. Further, when the MUX is turned-on, a signal (reference voltage) needed for data driving can be output to the data lines DL1 to DLm. When the MUX is turned-off, the signal can not be output to the data lines DL1 to DLm. Such a MUX will be described later with reference to FIG. 4.

FIG. 2 is a circuit diagram illustrating an example of a pixel illustrated in FIG. 1. FIG. 2 illustrates, as an example, a pixel PXij that is connected to an i-th gate line GLi and a j-th data line DLj, where i and j can be positive numbers such as positive integers. The pixel configuration shown in FIG. 2 can be used in each pixel of FIG. 1 or other pixels discussed herein.

Referring to FIG. 2, the pixel PXij includes a switching transistor ST, a driving transistor DT, a storage capacitor Cst, and a light-emitting element LD.

A first electrode (for example, a source electrode) of the switching transistor ST is electrically connected to the j-th data line DLj. A second electrode (for example, a drain electrode) of the switching transistor ST is electrically connected to a first node N1. A gate electrode of the switching transistor ST is electrically connected to the i-th gate line GLi. The switching transistor ST is turned on, and transmits a data signal applied to the j-th data line DLj to the first node N1 when a gate signal at a gate-on level is applied to the i-th gate line GLi.

A first electrode of the storage capacitor Cst is electrically connected to the first node N1. A second electrode of the storage capacitor Cst can be configured to receive the high-potential driving voltage ELVDD. The storage capacitor Cst can charge a voltage corresponding to a difference between a voltage applied to the first node N1 and the high-potential driving voltage ELVDD.

A first electrode (for example, a source electrode) of the driving transistor DT is configured to receive the high-potential driving voltage ELVDD. A second electrode (for example, a drain electrode) of the driving transistor DT is electrically connected to a first electrode (for example, an anode electrode) of the light-emitting element LD. A gate electrode of the driving transistor DT is electrically connected to the first node N1. The driving transistor DT is turned on when a voltage at a gate-on level is applied through the first node N1. The driving transistor DT can control the amount of a driving current flowing to the light-emitting element LD in response to a voltage provided to the gate electrode.

The light-emitting element LD outputs light corresponding to the driving current. The light-emitting element LD can output light corresponding to any one of red, green, blue, and white colors. The light-emitting element LD can be an organic light-emitting diode (OLED) or an ultra-small inorganic light-emitting diode having a size in a micro to nanoscale range, but the embodiment is not limited thereto. Hereinafter, the technical idea of the present embodiment will be described with reference to the exemplary embodiment in which the light-emitting element LD is formed of an organic light-emitting diode.

In the present embodiment, the structure of the pixels PXij is not limited to that shown in FIG. 2. According to an embodiment, the pixels PXs can further include at least one element for compensating for a threshold voltage of the driving transistor DT, or initializing a voltage of the gate electrode of the driving transistor DT and/or a voltage of the anode electrode of the light-emitting element LD.

FIG. 2 illustrates an example in which the switching transistor ST and the driving transistor DT are PMOS transistors, but the present embodiment is not limited thereto. For example, at least some or all of the transistors constituting each pixel PXij can be constructed as NMOS transistors. In various embodiments, each of the switching transistor ST and the driving transistor DT can be implemented as a low-temperature polycrystalline silicon (LTPS) thin-film transistor, an oxide thin-film transistor, or a low-temperature polycrystalline oxide (LTPO) thin-film transistor.

FIG. 3 is a perspective view schematically illustrating a display panel illustrated in FIG. 1.

Referring to FIG. 3, in association with FIGS. 1 and 2, components of the display device 1 will be described in more detail.

The display device 1 can be implemented in various shapes. For example, the display device 1 can be implemented in a shape of a rectangular plate. However, the present embodiment is not limited thereto, and the display device 1 can have various shapes such as a square shape, a circular shape, an elliptical shape, and a polygonal shape, and a part of the corner can be formed as a curved surface or can have a shape in which thickness is changed in at least one area. In addition, all or part of the display device 1 can have flexibility.

The display panel 50 includes a display area DA and a non-display area NDA. The display area DA is an area in which the pixels PXs are disposed, and can be referred to as an active area. The non-display area NDA can be disposed around the display area DA. For example, the non-display area NDA can be disposed along a border of the display area DA. The non-display area NDA can comprehensively refer to areas other than the display area DA on the display panel 50, and can be referred to as a non-active area.

In the non-display area NDA, as a driver for driving the pixels PXs, for example, the gate driver 20 can be provided. The gate driver 20 can be disposed adjacent to one side or both sides of the display area DA, in the non-display area NDA. The gate driver 20 can be formed in the non-display area NDA of the display panel 50 in a gate-in-panel manner as shown in FIG. 3. However, in another embodiment, the gate driver 20 is made of a driving chip and mounted on a flexible film and the like, and can be attached to the non-display area NDA by a tape automated bonding (TAB) manner.

In the non-display area NDA, multiple pads can be provided. The pads can not be covered by an insulation layer, but can be exposed to the outside of the display panel 50 and can be electrically connected to the data driver 30, a circuit board 70, and the like that will be described later.

The display panel 50 can include wirings for supplying electrical signals to the pixels PXs. The wirings can include, for example, the gate lines GL1 to GLn, the data lines DL1 to DLm, and the power lines PL1 and PL2.

The power lines PL1 and PL2 are electrically connected to the power supply 40 (or the timing controller 10) through the connected pads. The power lines PL1 and PL2 can provide the high-potential driving power ELVDD and the low-potential driving power ELVSS, provided from the power supply 40 (or the timing controller 10), to the pixels PXs.

A flexible film 60 is provided with a first end attached to a pad area PA of the display panel 50, and is provided with a second end attached to the circuit board 70. The display panel 50 and the circuit board 70 can be electrically connected to each other. The flexible film 60 can include multiple wirings for electrically connecting the pads formed in the pad area PA and the wirings of the circuit board 70 to each other. In an embodiment, the flexible film 60 can be attached on the pads through an anisotropic conducting film (ACF).

When the data driver 30 is made of a driving chip, the data driver 30 can be mounted on the flexible film 60 in the chip on film (COF) or chip on plastic (COP) manner. The data driver 30 can generate a data signal on the basis of the image data DATA and the data driving control signal CONT2 output from the timing controller 10. The data driver 30 can provide the generated data signals to the data lines DL1 to DLm through the connected pads.

Multiple circuits implemented with driving chips can be mounted on the circuit board 70. The circuit board 70 can be a printed circuit board or a flexible printed circuit board, but the type of the circuit board 70 is not limited thereto.

The circuit board 70 can include the timing controller 10 and the power supply 40 mounted in the form of an integrated circuit. In FIG. 3, the timing controller 10 and the power supply 40 are illustrated as separate components, but the present embodiment is not limited thereto. For example, in various embodiments, the power supply 40 can be integrally provided with the timing controller 10 or the timing controller 10 can be configured to perform a function of the power supply 40.

FIG. 4 is a view illustrating a driving of multiplexers according to an embodiment of the present disclosure.

Before a detailed description, in the present specification, it should be understood that the multiplexers are three multiplexers MUX1 to MUX3 for the consistency and ease of understanding of the description. However, it should be understood that the technical idea of the present disclosure is not limited by a specific number of the multiplexer. When a different number of multiplexers (two multiplexers or four multiplexers) are provided, the present embodiments can be applied identically or equally.

Referring to FIG. 4, the multiple pixels PXs are illustrated, and each pixel PX includes sub-pixels SPXs. As an example, it is illustrated that one pixel PX includes three sub-pixels SPXs.

Each sub-pixel SPX can be connected to the data lines DL1 to DL9. As an example, nine sub-pixels SPXs are described, and more sub-pixels SPXs and pixels PXs can be disposed to a right direction.

Each sub-pixel SPX can be connected to the gate lines GL1 to GL3. As an example, three gate lines GL1 to GL3 are described, and more gate lines GL can be disposed downward.

Multiple switches SWs are disposed at input terminals of the data lines DL1 to DL9, respectively. When these switches SWs are turned-on, a signal (voltage) can be output to the data lines DL1 to DL9. When the switches SWs are turned-off, the signal can not be output to the data lines DL1 to DL9.

These switches can be controlled by three MUX lines MUX1, MUX2, and MUX3. The switches SWs are controlled by three MUX lines MUX1, MUX2, and MUX3, which can be referred to as a 3MUX structure. Since the switches SWs are controlled by the MUX lines, the MUX and the MUX line can be used interchangeably.

There are shown three channels CH1 to CH3 in FIG. 4. Video data is input through the channels CH1 to CH3 to the sub-pixel SPX For example, when the first MUX MUX1 is turned-on, video data transmitted through the channel CH1 is input to red sub-pixels. When the second MUX MUX2 is turned on, video data transmitted through the channel CH2 is input to green sub-pixels. When the third MUX MUX3 is turned on, video data transmitted through the channel CH3 is input to blue sub-pixels.

Specifically, when the first MUX MUX1 is turned-on, signals can be output to the pixels PX11, PX21, and PX31, or the sub-pixels SPXs connected to the data lines DL1 to DL3. For example, when a scan signal Scan is supplied through the first gate line GL1 while the first MUX MUX1 is turned-on, the pixel PX11 can be driven.

In addition, when the second MUX MUX2 is turned-on, signals can be output to the pixels PX12, PX22, and PX32, or the sub-pixels SPXs connected to the data lines DL4 to DL6. For example, when the scan signal Scan is supplied through the first gate line GL1 while the second MUX MUX2 is turned-on, the pixel PX12 can be driven.

In addition, when the third MUX MUX3 is turned-on, signals can be output to the pixels PX13, PX23, and PX33, or the sub-pixels SPXs connected to the data lines DL7 to DL9. For example, when the scan signal Scan is supplied through the first gate line GL1 while the third MUX MUX3 is turned-on, the pixel PX13 can be driven.

In this manner, a period in which the scan signal Scan is supplied through one gate line (for example, the first gate line GL1) can be referred to as one H period or a 1 horizontal period. The H period is supplied sequentially according to the gate lines. For example, the scan signal Scan is supplied to the first gate line GL1, followed by the second gate line GL2, followed by the third gate line GL3, and then sequentially followed by the next gate lines.

FIG. 5 is a view illustrating the driving of the MUXs and a driving of a scan signal according to an embodiment of the present disclosure.

FIG. 6 shows a graph illustrating a signal charging of the pixels by the driving of the MUXs according to an embodiment of the present disclosure.

FIGS. 7 and 8 are views illustrating a light-emitting of the pixels by the driving of the MUXs according to an embodiment of the present disclosure.

An embodiment of the present disclosure will be described with reference to FIGS. 5 to 8.

Referring to FIG. 5, three H periods are illustrated. As described above, one H period refers to a period in which the pixels PXs connected to any one gate line are driven (light-emission). In the example illustrated in FIG. 5, an H period in which a k−1th gate line is driven, an H period in which a kth gate line is subsequently driven, and an H period in which a k+1th gate line is subsequently driven are illustrated.

For reference, one frame (1 frame) refers to a period in which all the pixels PXs disposed on the display panel 50 are driven. For example, for the display panel 50 that includes m gate lines and n data lines, the 1 frame is a period in which the total number of pixels PXs that correspond to the product of m and n are driven. In addition, since there is a period (turn-on period) in which the first MUX, the second MUX, and the third MUX are turned-on during one H period, the first MUX and the second MUX, and the third MUX are each turned-on m times during 1 frame.

Referring to FIG. 5 again, on the basis of the H period of the kth gate line, an initialization period (1), the first MUX turn-on period (2), the second MUX turn-on period (3), the third MUX turn-on period (4), and a sampling period (5) are illustrated. A MUX signal and the scan signal Scan according to the present disclosure are illustrated as a P-type. Therefore, it should be understood that the MUX is turned-on when an electric potential level of the signals is a low level, and the MUX is turned-off when the electric potential level of the signals is a high level.

The initialization period (1) is a period in which the pixels PXs disposed on the kth gate line is initialized. The initialization period (1) can be a sampling period of the previous gate line that is the k−1th gate line.

The first MUX turn-on period (2) is a period in which the first MUX MUX1 is turned-on. For example, referring to FIG. 7, the pixels PX11, PX21, and PX31 can be supplied with a driving signal.

The second MUX turn-on period (3) is a period in which the second MUX MUX2 is turned-on. For example, retelling to FIG. 7, the pixels PX12, PX22, and PX32 can be supplied with a driving signal.

The third MUX turn-on period (4) is a period in which the third MUX MUX3 is turned-on. For example, referring to FIG. 7, the pixels PX13, PX23, and PX33 can be supplied with a driving signal.

According to an embodiment of the present disclosure, in the H period of the kth gate line, the first MUX turn-on period (2), the second MUX turn-on period (3), and the third MUX turn-on period (4) do not overlap with each other.

The sampling period (5) is a period in which the scan signal Scan n is turned-on to the corresponding gate line that is the kth gate line. Since the scan signal Scan n is input to the kth gate line, the pixels PXs connected to the corresponding gate line can be driven (light-emission).

Here, during the H period, the length of the turn-on period of the first MUX MUX1 can differ from the length of the turn-on period of the third MUX MUX3. In addition, the length of the turn-on period of the first MUX MUX1 can be the same as the length of the turn-on period of the second MUX MUX2. The technical idea of the present disclosure is that multiple MUX signals can differ from each other. As another embodiment of FIG. 5, the turn-on period of the first MUX MUX1 can be the longest, and the lengths of the turn-on period of the second MUX MUX2 and the turn-on period of the third MUX MUX3 can be the same.

According to the present disclosure, the turn-on period of the third MUX MUX3 can overlap the sampling period. It will be described in the example in FIG. 5 that the turn-on period of the third MUX (4) overlaps the sampling period (5). Here, a start time of the turn-on of the third MUX MUX3 should precede a start time of a sampling signal. This is because, when the sampling signal starts in advance, since the charging of the pixels PXs connected to the third MUX MUX3 starts after the light-emitting starts, the efficiency of the light-emitting becomes low.

Referring to FIG. 6, the initialization period (1), the first MUX turn-on period (2), the second MUX turn-on period (3), the third MUX turn-on period (4), and the sampling period (5) are illustrated. Further, a light-emitting driving voltage that is charged to the pixels PX1, PX2, and PX3 for each of the periods is illustrated.

The pixel PX1 in FIG. 6 can be the pixels driven by the first MUX MUX1. For example, the pixel PX1 can be the pixels PX11, PX21, and PX31 in FIG. 7.

The pixel PX2 can be the pixels driven by the second MUX MUX2. For example, the pixel PX2 can be the pixels PX12, PX22, and PX32 in FIG. 7.

The pixel PX3 can be the pixels driven by the third MUX MUX3. For example, the pixel PX3 can be the pixels PX13, PX23, and PX33 in FIG. 7.

It should be understood that the graph in FIG. 6 is drawn for one H period. Therefore, assuming that the one H period is a horizontal cycle for the first gate line GL1 in FIG. 7, the pixels PXs that emit light in the graph in FIG. 6 will be described as the pixels PX11, PX12, and PX13 in FIG. 7.

Returning to FIG. 6 again, the light-emitting driving voltage of the pixels PX1, PX2, and PX3 is initialized during the initialization period (1).

In the first MUX turn-on period (2), when the first MUX MUX1 is turned-on, the driving voltage of the pixel PX1 increases and then is saturated with a preset voltage. Referring to FIG. 7, the pixel PX11 can be charged.

In the second MUX turn-on period (3), when the second MUX MUX2 is turned-on, the driving voltage of the pixel PX2 increases and then is saturated with the preset voltage. Referring to FIG. 7, the pixel PX12 can be charged.

In the third MUX turn-on period (4), when the third MUX MUX3 is turned-on, the driving voltage of the pixel PX3 increases and then is saturated with the preset voltage. Referring to FIG. 7, the pixel PX13 can be charged.

As illustrated in FIG. 6, the third MUX turn-on period (4) can overlap the sampling period (5). In addition, the third MUX turn-on period (4) can start earlier than the sampling period (5).

When the scan signal Scan is supplied to the gate line (for example, the first gate line GL1 in FIG. 7) by the sampling period (5), the pixels PX1, PX2, and PX3 can emit light. During the sampling period (5), the charging voltage of the pixels PX1 and PX2 in which the MUX signal has turned-off are boosted. However, the charging voltage of the pixel PX3 that the sampling period (5) and the turn-on period thereof are overlapped can not be boosted. As a result, the pixels PX1 and PX2 have a high luminance, while the pixel PX3 can have a relatively low luminance, and the degradation of the luminance of the pixel PX3 can be due to the difference in the charging voltage D.

Referring to FIG. 7, during a first H period of the first gate line GL1, the luminance of the pixels PX11 and the PX12 that are respectively connected to the first MUX MUX1 and the second MUX MUX2 is high, but the luminance of the pixel PX13 that is connected to the third MUX MUX3 can be relatively low. During a second H period of the second gate line GL2, the luminance of the pixels PX21 and PX22 that are respectively connected to the first MUX MUX1 and the second MUX MUX2 is high, but the luminance of the pixel PX23 that is connected to the third MUX MUX3 can be relatively low. In addition, during a third H period of the third gate line GL3, the luminance of the pixels PX31 and PX32 that are respectively connected to the first MUX MUX1 and the second MUX MUX2 is high, but the luminance of the pixel PX33 that is connected to the third MUX MUX3 can be relatively low.

Accordingly, referring to FIG. 8, the pixels of 3nth (n is a natural number larger than 0) in a horizontal direction can have a low luminance. This results a vertical black line perceived when viewed from the whole of the display panel 50.

FIG. 9 is a view illustrating the driving of the MUXs and the driving of the scan signal according to an embodiment of the present disclosure.

FIGS. 10 and 11 are views illustrating the light-emitting of the pixels by the driving of the MUXs according to an embodiment of the present disclosure.

An embodiment of the present disclosure will be described with reference to FIGS. 9 to 11.

Referring to FIG. 9 three H periods are illustrated. As described above, the one H period refers to a period in which the pixels connected to any one gate line are driven (light-emission). In the example in FIG. 9, a first H period in which a first gate line is driven, a second H period in which a second gate line is subsequently driven, and a third H period in which a third gate line is subsequently driven are illustrated. However, this should be understood that it is an example for the convenience of explanation and understanding. The first H period does not necessarily refer to the first gate line, but it should be understood as a first gate line of any of the three gate lines. In addition, it should be understood that the initialization period (1) in the description that is referring to FIG. 5 is intentionally omitted in order to avoid a duplicate description.

Referring to FIG. 9 again, during the first H period, a first MUX turn-on period (2-1), a second MUX turn-on period (3-1), a third MUX turn-on period (4-1), and a sampling period (5-1) are illustrated. According to the present disclosure, the third MUX turn-on period (4-1) can be longer than the first MUX turn-on period (2-1). The third MUX turn-on period (4-1) also can be longer than the second MUX turn-on period (3-1). In addition, the third MUX turn-on period (4-1) can overlap the sampling period (5-1), but a start time of the third MUX turn-on period (4-1) can be earlier than a start time of the sampling period (5-1).

In addition, during the second H period, a third MUX turn-on period (4-2), a second MUX turn-on period (3-2), a first MUX turn-on period (2-2), and a sampling period (5-2) are sequentially illustrated. According to the present disclosure, the first MUX turn-on period (2-2) can be longer than the second MUX turn-on period (3-2). The first MUX turn-on period (2-2) also can be longer than the third MUX turn-on period (4-2). In addition, the first MUX turn-on period (2-2) can overlap the sampling period (5-2), but a start time of the first MUX turn-on period (2-2) can be earlier than a start time of the sampling period (5-2).

In addition, during the third H period, a first MUX turn-on period (2-3), a third MUX turn-on period (4-3), a second MUX turn-on period (3-3), and a sampling period (5-3) are sequentially illustrated. According to the present disclosure, the second MUX turn-on period (3-3) can be longer than the first MUX turn-on period (2-3). The second MUX turn-on period (3-3) also can be longer than the third MUX turn-on period (4-3). In addition, the second MUX turn-on period (3-3) can overlap the sampling period (5-3), but a start time of the second MUX turn-on period (3-3) can be earlier than a start time of the sampling period (5-3).

Here, describing again on the basis of an Nth MUX, the length of the first MUX turn-on period of the first H period can differ from that of the first MUX turn-on period of the second H period. In addition, the length of the Nth MUX (the third MUX when N equals 3) turn-on period of the first H period can differ from that of the Nth MUX turn-on period of the second H period. In addition, the length of the first MUX turn-on period at the first H period can be the same as that of the Nth MUX turn-on period at the second H period. In addition, the length of the Nth MUX turn-on period at the first H period can be the same as that of the first MUX turn-on period at the second H period.

For example, the length of the first MUX turn-on period can vary depending on the H period. In the example in FIG. 9, the length of the first MUX turn-on period (2-1) at the first H period can differ from that of the first MUX turn-on period (2-2) at the second H period. Likewise, the length of the Nth MUX turn-on period can vary depending on the H period. As a result, the length of the turn-on period of any MUX can be changed for each gate line.

In addition, the turn-on period of MUX having the longest turn-on period among the MUXs of one H period can be performed last. For example, among the first H period in FIG. 9, the MUX having the longest turn-on period is the third MUX MUX3, and is performed last comparing to the other MUXs in the first H period. Therefore, the turn-on period of the MUX having the longest turn-on period can overlap the sampling period. However, the start of the third MUX MUX3 turn-on period should precede the start of the sampling period.

As another example, among the third H period in FIG. 9, the MUX having the longest turn-on period is the second MUX MUX2, and is performed last comparing to the other MUXs in the third H period. Therefore, the turn-on period of the MUX having the longest turn-on period can overlap the sampling period. However, the start of the second MUX MUX2 turn-on period should precede the start of the sampling period.

For example, the MUX having the longest turn-on period in one H period should be controlled to be performed last comparing to the other MUXs. Accordingly, the MUX having the longest turn-on period can overlap the sampling period.

In addition, as described later with reference to FIGS. 12A to 13C, the turn-on period of the first MUX to the Nth MUX can vary depending on the frame. For example, the turn-on period of the MUX can be changed depending on the frame. A more detailed description will be described later with reference to FIGS. 12A to 13C.

Referring to FIG. 10 again, during the first H period of the first gate line GL1, the luminance of the pixels PX11 and the PX12 that are respectively connected to the first MUX MUX1 and the second MUX MUX2 is high, but the luminance of the pixel PX13 that is connected to the third MUX MUX3 can be relatively low. During the second H period of the second gate line GL2, the luminance of the pixels PX22 and PX23 that are respectively connected to the second MUX MUX2 and the third MUX MUX3 is high, but the luminance of the pixel PX21 that is connected to the first MUX MUX1 can be relatively low. In addition, during the third H period of the third gate line GL3, the luminance of the pixels PX31 and PX33 that are respectively connected to the first MUX MUX1 and the third MUX MUX3 is high, but the luminance of the pixel PX32 that is connected to the second MUX MUX2 can be relatively low.

Therefore, referring to FIG. 11, on the basis of the vertical line (data line), pixels with continuously low luminance do not appear. Therefore, a problem that the vertical black line is perceived when viewed from the whole of the display panel can be prevented. In other words, the luminance-reduced pixel generated by the driving of the Nth MUX according to the present disclosure is distributed throughout a screen, so that a poor visibility can be prevented.

FIGS. 12A to 12C are views illustrating the driving of the MUXs and the driving of the scan signal according to an embodiment of the present disclosure.

FIGS. 13A to 13C are views illustrating the light-emitting of the pixels by the driving of the MUXs according to an embodiment of the present disclosure.

An embodiment of the present disclosure will be described with reference to FIGS. 12A to 13C.

Referring to FIGS. 12A to 12C, three H periods for each of three frames (a first frame, a second frame, a third frame) are illustrated. As described above, one second can include multiple frames depending on a frame rate. For example, in 120 Hz driving, 120 frames can be included in one second. Therefore, in the embodiment, it should be understood that the three frames refer to any of the three consecutive frames. Further, it should be understood that the three frames do not necessarily refer to the first, the second, and the third frames. In addition, as described above, the one H period refers to a period in which the pixels connected to any one gate line are driven (light-emission). In the example in FIGS. 12A to 12C, a first H period in which a first gate line is driven, a second H period in which a second gate line is subsequently driven, and a third H period in which a third gate line is subsequently driven are illustrated. However, this should be understood that it is an example for the convenience of explanation and understanding. The first H period does not necessarily refer to the first gate line, but it should be understood as a first gate line of any of the three gate lines. In addition, it should be understood that the initialization period (1) in the description that is referring to FIG. 5 is intentionally omitted in order to avoid a duplicate description.

Again, referring to FIGS. 12A to 12C, in the first frame, a first pattern Pattern 1 of the turn-on period of the first to the third MUXs MUX1, MUX2, and MUX3 during the first H period is illustrated. A second pattern Pattern 2 of the turn-on period of the first to the third MUXs MUX1, MUX2, and MUX3 during the second H period is illustrated. A third pattern Pattern 3 of the turn-on period of the first to the third MUXs MUX1, MUX2, and MUX3 during the third H period is illustrated. The first pattern, the second pattern, and the third pattern are as described with reference to FIG. 9.

In the second frame, the third pattern Pattern 3 of the turn-on period of the first to the third MUXs MUX1, MUX2, and MUX3 during the first H period is illustrated. The first pattern Pattern 1 of the turn-on period of the first to the third MUXs MUX1, MUX2, and MUX3 during the second H period is illustrated. The second pattern Pattern 2 of the turn-on period of the first to the third MUXs MUX1, MUX2, and MUX3 during the third H period is illustrated.

In the third frame, the second pattern Pattern 2 of the turn-on period of the first to the third MUXs MUX1, MUX2, and MUX3 during the first H period is illustrated. The third pattern Pattern 3 of the turn-on period of the first to the third MUXs MUX1, MUX2, and MUX3 during the second H period is illustrated. The first pattern Pattern 1 of the turn-on period of the first to the third MUXs MUX1, MUX2, and MUX3 during the third H period is illustrated.

Here, describing on the basis of an Nth MUX is as follows. Assuming that the N is 3, the N MUXs can include the first MUX, the second MUX, and the third MUX. The first H period of the first frame has the first pattern, and the length of the turn-on period of the third MUX in the first pattern is different from those of the turn-on period of the first MUX and the turn-on period of the second MUX. For example, the third MUX turn-on period can have a relatively longer turn-on period. It is the same as described above that the start time of the third MUX turn-on period should precede the start time of the sampling signal. For example, any one of the three MUXs can have the longest turn-on period, and the longest MUX turn-on period can be performed last. In addition, the MUX turn-on period having the longest turn-on period can overlap the sampling period. At this time, the start time of the MUX turn-on period can precede the start time of the sampling period.

In addition, in the first frame, the second H period performed after the first H period has the second pattern that is different from the first pattern. In addition, the third H period performed after the second H period has the third pattern that is different from the second pattern.

Meanwhile, in the second frame performed after the first frame, the first H period can have the third pattern. For example, the pattern in the first H period of the first frame and the pattern in the first H period of the second frame are different from each other. When the pattern at the first H period in the second frame is referred to as a fourth pattern, the fourth pattern can differ from the first pattern.

The second H period in the second frame can have the first pattern. For example, the pattern in the second H period of the first frame and the pattern in the second H period of the second frame are different from each other. When the pattern at the second H period in the second frame is referred to as a fifth pattern, the fifth pattern can differ from the second pattern.

The third H period in the second frame can have the second pattern. For example, the pattern in the third H period of the first frame and the pattern in the third H period of the second frame are different from each other. When the pattern at the third H period in the second frame is referred to as a sixth pattern, the sixth pattern can differ from the third pattern.

In addition, in the third frame performed after the second frame, the first H period can have the second pattern. For example, the pattern in the first H period of the second frame and the pattern in the first H period of the third frame are different from each other. When the pattern at the first H period in the third frame is referred to as a seventh pattern, the seventh pattern can differ from the fourth pattern.

The second H period in the third frame can have the third pattern. For example, the pattern in the second H period of the second frame and the pattern in the second H period of the third frame are different from each other. When the pattern at the second H period in the third frame is referred to as an eighth pattern, the eighth pattern can differ from the fifth pattern.

The third H period in the third frame can have the first pattern. For example, the pattern in the third H period of the second frame and the pattern in the third H period of the third frame are different from each other. When the pattern at the third H period in the third frame is referred to as a ninth pattern, the ninth pattern can differ from the sixth pattern.

Referring to FIGS. 13A to 13C, the light-emitting of the pixels in each of the frames is illustrated. For example, in addition to that the turn-on pattern of the MUXs are driven differently according to the H period (or the gate line) as described with reference to FIG. 9, the turn-on pattern of the MUXs are driven differently according to the frames in the example described with reference to FIGS. 12A to 12C. Therefore, the luminance-reduced pixels that are distributed throughout the display panel are also distributed as the frames that change over time. Therefore, the efficiency of preventing the poor visibility can be more increased.

It will be understood by those skilled in the art that the present disclosure can be embodied in other specific forms without changing the technical idea or essential characteristics of the present disclosure. Therefore, it should be understood that the embodiments described above are illustrative in all aspects and not restrictive. The scope of the present disclosure is characterized by the appended claims rather than the detailed description described above, and it should be construed that all alterations or modifications derived from the meaning and scope of the appended claims and the equivalents thereof fall within the scope of the present disclosure.

What is claimed is:

1. A display device comprising:

a display panel including multiple pixels, each of the multiple pixels including multiple sub-pixels;

multiple data lines respectively connected to the multiple sub-pixels;

multiple gate lines respectively connected to the multiple pixels; and

N multiplexers (MUX) disposed at input terminals of the multiple data lines, where N is a natural number larger than 1, wherein, in one horizontal (H) period, a length of a turn-on period of a first MUX is different from a length of a turn-on period of an Nth MUX, where the one H period is a period in which a scan signal is supplied through one gate line among the multiple gate lines, wherein, in the one H period, a MUX having the longest turn-on period is performed last comparing to the other MUXs, and the turn-on period of the MUX that is performed last overlaps a sampling period of a scan signal, and wherein, a length of the turn-on period of the MUX that is performed last is larger than a length of the sampling period of the scan signal.

2. The display device of claim 1, wherein, in the one H period, the turn-on periods of the N MUXs do not overlap with each other.

3. The display device of claim 1, wherein a turn-on start time of the MUX that is performed last precedes a start time of the sampling period of the scan signal.

4. The display device of claim 3, wherein a length of a turn-on period of the first MUX in a first H period is different from a length of a turn-on period of the first MUX in a second H period.

5. The display device of claim 3, wherein a length of a turn-on period of the Nth MUX in a first H period is different from a length of a turn-on period of the Nth MUX in a second H period.

6. The display device of claim 3, wherein a length of a turn-on period of the first MUX in a first H period is the same as a length of a turn-on period of the Nth MUX in a second H period, and a length of a turn-on period of the Nth MUX in the first H period is the same as a length of a turn-on period of the first MUX in the second H period.

7. The display device of claim 3, wherein a length of a turn-on period of the first MUX changes depending on the one gate line.

8. The display device of claim 3, wherein a length of a turn-on period of the first MUX varies depending on the one H period, and the length of the turn-on period of the first MUX varies depending on a frame.

9. The display device of claim 3, wherein a length of a turn-on period of the Nth MUX varies depending on the one H period, and the length of the turn-on period of the Nth MUX varies depending on a frame.

10. The display device of claim 1, wherein a turn-on end time of the MUX that is performed last lags behind an end time of the sampling period of the scan signal.

11. The display device of claim 1, wherein the NMUXs comprise the first MUX, a second MUX, and a third MUX, a turn-on period of each of the first MUX, the second MUX, and the third MUX in a first period in a first frame has a first pattern, in which the turn-on period of the third MUX is the longest, the turn-on period of the third MUX overlaps a sampling period, and a start time of the turn-on period of the third MUX precedes a start time of the sampling period.

12. The display device of claim 11, wherein, in a second H period that is performed after the first H period in the first frame, the turn-on period of each of the first MUX, the second MUX, and the third MUX has a second pattern that is different from the first pattern.

13. The display device of claim 12, wherein, in a third H period that is performed after the second H period in the first frame, the turn-on period of each of the first MUX, the second MUX, and the third MUX has a third pattern that is different from the first and second patterns.

14. The display device of the claim 13, wherein a second frame is performed after the first frame, a fourth pattern of the turn-on period of each of the first MUX, the second MUX, and the third MUX in a first H period in the second frame is different from the first pattern, a fifth pattern of the turn-on period of each of the first MUX, the second MUX, and the third MUX in a second H period in the second frame is different from the second pattern, and a sixth pattern of the turn-on period of each of the first MUX, the second MUX, and the third MUX in a third H period in the second frame is different from the third pattern.

15. The display device of claim 14, wherein a third frame is performed after the second frame, a seventh pattern of the turn-on period of each of the first MUX, the second MUX, and the third MUX in a first H period in the third frame is different from the fourth pattern, an eighth pattern of the turn-on period of each of the first MUX, the second MUX, and the third MUX in a second H period in the third frame is different from the fifth pattern, and a ninth pattern of the turn-on period of each of the first MUX, the second MUX, and the third MUX in a third H period in the third frame is different from the sixth pattern.

16. A display device comprising:

a display panel including multiple pixels, each of the multiple pixels including multiple sub-pixels;

multiple data lines respectively connected to the multiple sub-pixels;

multiple gate lines respectively connected to the multiple pixels; and

N multiplexers (MUX) disposed at input terminals of the multiple data lines, where N is a natural number larger than 1, wherein, in one horizontal (H) period, a turn-on period of a MUX having the longest turn-on period among the N MUXs is performed last and overlaps a sampling period of a scan signal, where the one H period is a period in which the scan signal is supplied through one gate line, and wherein the MUXs having the longest turn-on period in adjacent H periods are different from each other.

17. A display device comprising:

a display panel including multiple pixels, each of the multiple pixels including multiple sub-pixels;

multiple data lines respectively connected to the multiple sub-pixels;

multiple gate lines respectively connected to the multiple pixels; and

N multiplexers (MUX) disposed at input terminals of the multiple data lines, where N is a natural number larger than 1, wherein, in one horizontal (H) period, a length of a turn-on period of a first MUX is different from a length of a turn-on period of an Nth MUX, where the one H period is a period in which a scan signal is supplied through one gate line among the multiple gate lines, wherein, in the one H period, a MUX having the longest turn-on period is performed last comparing to the other MUXs, and the turn-on period of the MUX that is performed last overlaps a sampling period of a scan signal, and wherein a turn-on start time of the MUX that is performed last precedes a start time of the sampling period of the scan signal.

* * * * *